US010131470B2

(12) United States Patent
Diao

(10) Patent No.: US 10,131,470 B2
(45) Date of Patent: Nov. 20, 2018

(54) BULK BAG WITH REDUCED MIDBODY CIRCUMFERENCE

(71) Applicant: Yuan Da Plastic Fabric Corp., Fremont, CA (US)

(72) Inventor: Qizhong Diao, Fremont, CA (US)

( * ) Notice: Subject to any disclaimer, the term of this patent is extended or adjusted under 35 U.S.C. 154(b) by 0 days.

(21) Appl. No.: 15/408,226

(22) Filed: Jan. 17, 2017

(65) Prior Publication Data

US 2017/0203916 A1 Jul. 20, 2017

Related U.S. Application Data

(60) Provisional application No. 62/279,682, filed on Jan. 16, 2016.

(51) Int. Cl.
*B65D 33/10* (2006.01)
*B65D 88/16* (2006.01)

(52) U.S. Cl.
CPC ..... *B65D 33/105* (2013.01); *B65D 88/1612* (2013.01)

(58) Field of Classification Search
CPC ..... B65D 33/105; B65D 88/1612
USPC ..... 383/22, 24, 119, 907, 6
See application file for complete search history.

(56) References Cited

U.S. PATENT DOCUMENTS 4,271,883 A * 6/1981 Krause ..... B65D 88/1693 222/181.3
5,073,035 A * 12/1991 Williams ..... B65D 88/1631 383/119
6,010,245 A * 1/2000 Ross ..... B65D 88/1631 383/105
6,109,785 A * 8/2000 Ross ..... B65D 88/1631 383/105
7,536,840 B2 * 5/2009 Ours ..... B65D 71/0088 53/173
9,751,691 B2 * 9/2017 Hunter ..... B65D 90/205
2008/0101730 A1 * 5/2008 Schnaars ..... B65D 88/1681 383/32
2008/0296195 A1 * 12/2008 Suarez ..... B65D 88/1618 206/524.1
2012/0217185 A1 * 8/2012 Ours ..... B65B 1/02 206/597
2012/0318790 A1 * 12/2012 Ours ..... B65B 1/02 220/9.4
2017/0008696 A1 * 1/2017 Porner ..... B65D 88/1625

FOREIGN PATENT DOCUMENTS

CA 2867396 A1 * 9/2013
EP 0665175 A1 * 8/1995
WO WO 2006014146 A2 * 2/2006 ..... B65D 88/1631

* cited by examiner

*Primary Examiner* — Jes F Pascua
(74) *Attorney, Agent, or Firm* — Thomas H. Ham; Loza & Loza, LLP

(57) ABSTRACT

A bulk bag includes a bulk bag body that is configured to have a varying circumference with a reduced circumference between the top and bottom of the bulk bag body to reduce bulging when the bulk bag body is filled with content.

15 Claims, 3 Drawing Sheets

BULK BAG WITH REDUCED MIDBODY CIRCUMFERENCE

CROSS REFERENCE TO RELATED APPLICATION

This application is entitled to the benefit of U.S. Provisional Patent Application Ser. No. 62/279,682, filed on Jan. 16, 2016, which is incorporated herein by reference.

BACKGROUND OF THE INVENTION

Bulk bags are used for the transportation of bulk loose materials. Bulk bags are usually fabricated by stitching or sewing pieces of woven fabric into various shapes, including a tubular shape. A conventional bulk bag has a lifting mechanism in the form of lift straps or lifting stevedores sewn onto the body fabric so that the bulk bag can be lifted by a forklift or other lifting machinery using the lifting mechanism of the bulk bag. A conventional bulk bag has square or rectangular walls which can be made with various way, such as U-panel, circular, 4-panel, etc.

Prior art bulk bags have various issues with the shape of the bag after filling. Due to the flexible nature of the body fabric, after the bag is filled, the sides of the bags will naturally round out or bulge out from the original square or rectangular shape. Since the top and bottom pieces of the bag is usually square or rectangular, the bulging-out is more severe where it is farther away from the top and bottom of the bag. The most severe part of the bulging is about the middle portion along the vertical direction of the walls. Due to the gravity of the content in the bag, the most severe location is usually slightly lower than the very middle point of the wall.

It has been a significant problem when a bulk bag bulges out. When the bag is loaded into a truck or ocean shipping container, the bag footprint size has to be significantly reduced so the bags can fit into the space. This leaves valuable space unfilled in the truck. The shipping costs per unit is increased due to this waste.

During bag handling, bulging-out portion of the bag usually over-hang outside of the pallet. This significantly increases the chance of bag damage since the over-hanging portion can rub against the truck wall, another bag, the neighboring pallet or the filling/handing machinery.

Another impact of the bulging is the bag stability. The bulging-out portion is outside of the footprint of the bag. This can render the bag into an unstable state especially when the bag is taller, being moved, or placed on an uneven surface.

Over the short history of bulk bags, very significant efforts have been spent to develop all different types of baffled bags to solve the bulging problem. A baffle is normally a piece of fabric or threads placed inside of the bag, connecting the neighboring or opposite walls of the bag from inside so the walls can be held in position when the bag is filled. If inside of a liner, baffles made of materials similar to the liner, can be used in the similar fashion to achieve the similar result. Other than the baffled bags, there has been no other successful ways developed to solve the bulging problem on a bulk bag.

Baffled bags are successful in reducing the bulging of the bag. Some bulging still exists on baffled bags on the wall fabric between the baffle connecting points. The major problem with baffled bags is apparently the much higher cost. More material is needed to make the bag and the manufacturing process is much slower. The presence of a baffle also increases the chance of contamination to the content of the bag.

There have been barely any other successes in reducing the bag bulging other than the usage of baffles. There is one work where the top edge of the bag is reduced hopefully the keep the body vertically straight but it does not improve the bulging which is caused by the natural round out of the body.

SUMMARY OF THE INVENTION

A bulk bag includes a bulk bag body that is configured to have a varying circumference with a reduced circumference between the top and bottom of the bulk bag body to reduce bulging when the bulk bag body is filled with content.

A bulk bag in accordance with embodiments of the invention comprises a bulk bag body that includes a top portion, a bottom portion and a side portion, where the top portion defines a top of the bulk bag body and the bottom portion defines a bottom of the bulk bag body, and a plurality of lift straps attached to the bulk bag body. The bulk bag body is configured so that a circumference of the bulk bag body at a particular height between the top and bottom of the bulk bag body is less than a circumference of the bulk bag body at the top of the bulk bag body and less than a circumference of the bulk bag body at the bottom of the bulk bag body to reduce bulging at the side portion of the bulk bag body when the bulk bag body is filled with content. In an embodiment, the side portion of the bulk bag body is made of a circular tube of fabric.

Other aspects and advantages of the present invention will become apparent from the following detailed description, taken in conjunction with the accompanying drawings, illustrated by way of example of the principles of the invention.

DETAILED DESCRIPTION

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

Figure 1:
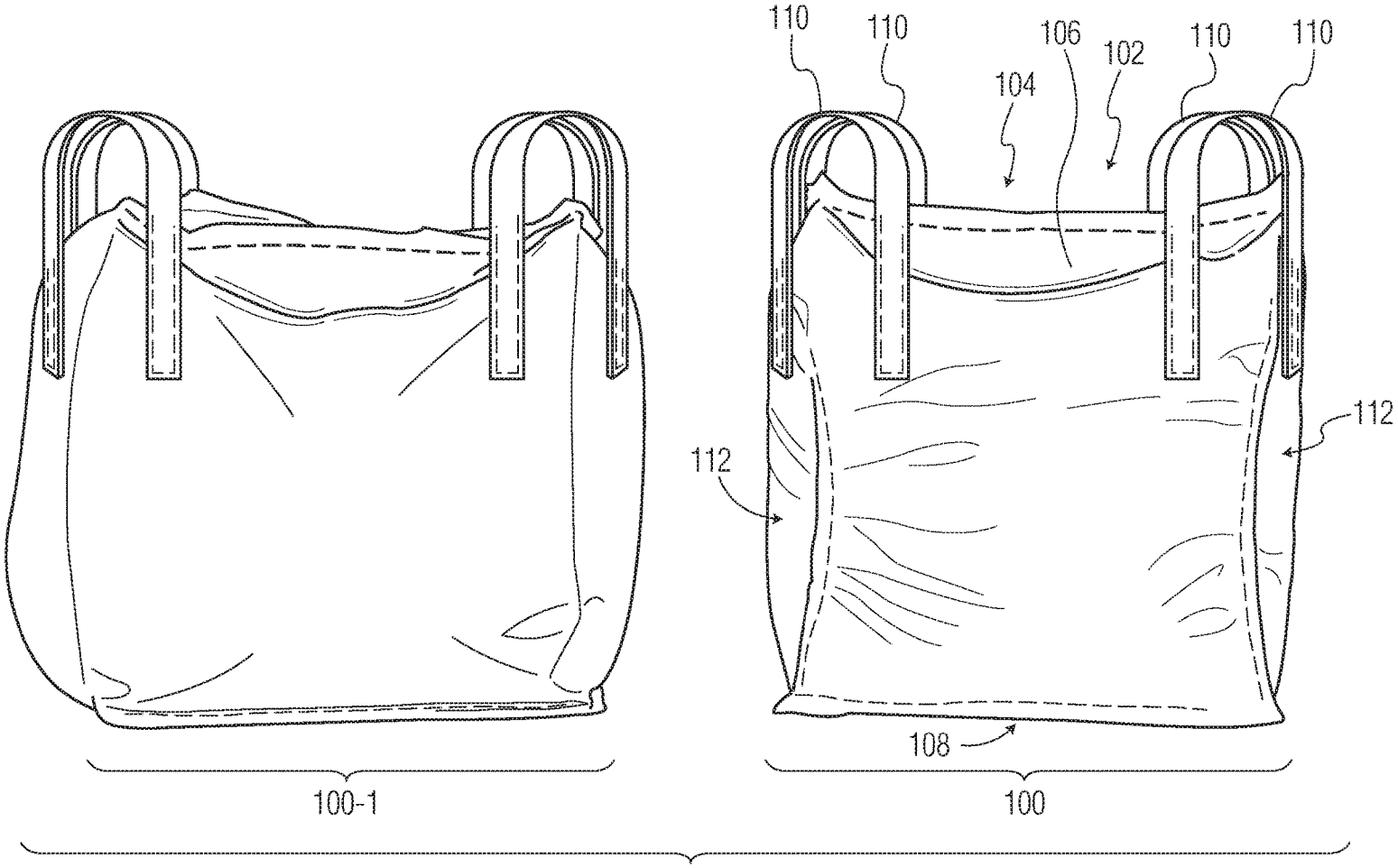
FIG. 1 is a front side view of a bulk bag in accordance with an embodiment of the invention.
Figure 2:
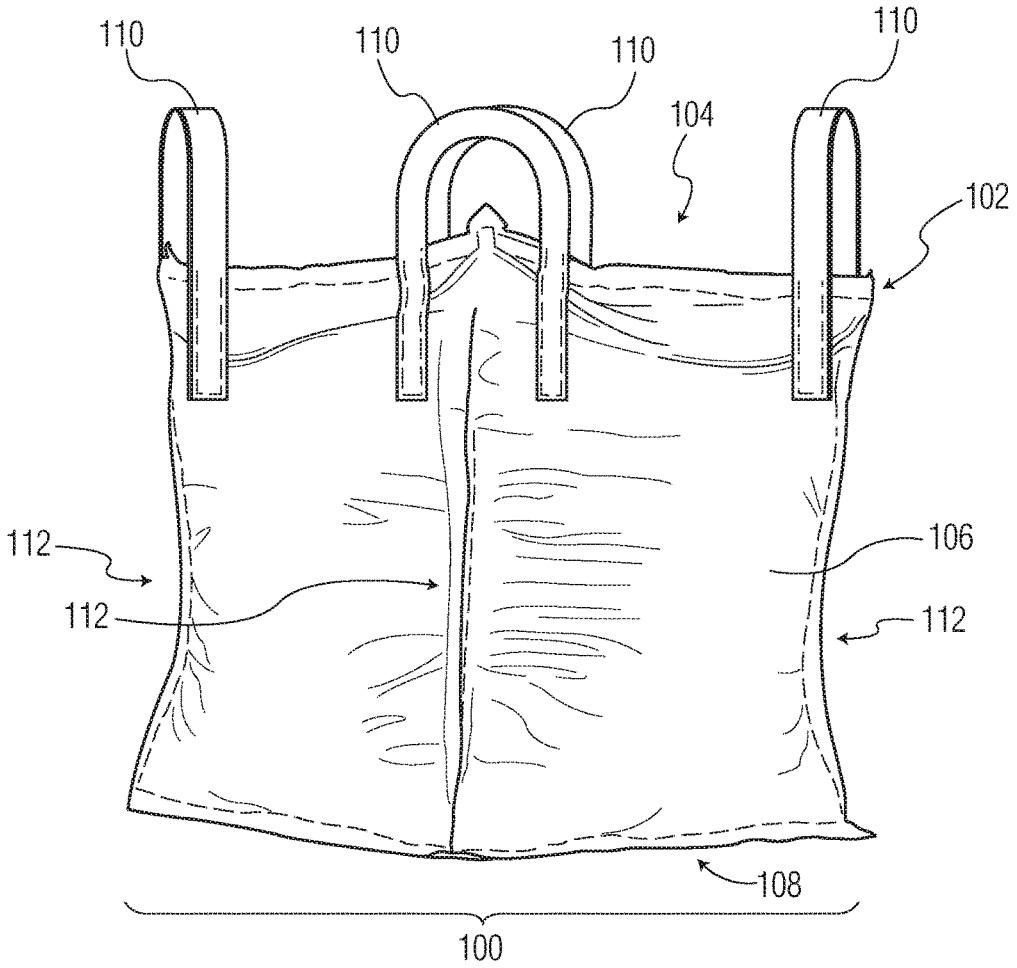
FIG. 2 is a front corner view of the bulk bag shown in FIG. 1.

With reference to FIGS. 1 and 2, a bulk bag 100 in accordance with an embodiment of the invention is described. As best shown in FIG. 1, the bulk bag 100 includes a bulk bag body 102 that is formed of a top portion 104, a side portion 106 and a bottom portion 108. In an embodiment, the bulk bag body 102 is made of polypropylene woven fabric or other suitable material. The bulk bag body 102 can be made of single layer of fabric or multiple layers of fabric. The bulk bag 100 further includes a lifting mechanism in the form of lift straps 110, which are attached to the bulk bag body 102. As an example, the lift straps 110 may be sewn onto the bulk bag body 102. In an embodiment, the lift straps 110 are made of monofilament material and have a similar elasticity with the bulk bag body 102. As used herein, having a similar elasticity with the bulk bag body means having an elasticity that is within 10 percent of the elasticity of the bulk bag body. In other embodiments, the lift straps 110 may be attached to the bulk bag body in different known ways. Also, in other embodiments, the bulk bag 100 may include lifting stevedores (not shown) or other lifting mechanism attached to the bulk bag body 102.

In this embodiment, the side portion 106 of the bulk bag body 102 is made of a circular tube of fabric. The top and bottom portions 104 and 108, which are rectangular in shape, are sewn onto the tubular side portion 106 to form the bulk bag body. In order to reduce or eliminate bulging of the bulk bag 100 when the bulk bag is filled with content, the bulk bag body 102 is designed to have a gradual reduction of circumference at or near the middle of the bulk bag body (i.e., at or near the midway between the top and bottom of the bulk bag body). The amount of circumference reduction varies depending on the height position on the side portion 106 of the bulk bag body 102. At the very bottom and very top of the side portion 106 of the bulk bag body 102, the circumference reduction is zero or minimal. The circumference reduction increases gradually as the height position approaches the middle part of the bulk bag body 102. The maximum reduction area is at the height position of an area slightly below the middle of the bulk bag body, which corresponds to an area where the most bulging would normally occur in a typical bulk bag body of this type.

In this embodiment, the gradual circumference reduction of the bulk bag body 102 is achieved by creating pinches 112 on the bulk bag body. As shown in FIG. 1, the bulk bag body includes pinches 112 that extend vertically along the length of the bulk bag body 102 (i.e., from the bottom of the bulk bag body to the top of the bulk bag body). As used herein, a pinch 112 is a feature on the bulk bag body 102 that is formed by sewing or otherwise attaching a portion of the bulk bag body together to reduce the circumference of the bulk bag body. In the illustrated embodiment, the bulk bag body 102 has four pinches 112 at four corners of the bulk bag body that are defined by the corners of the top and bottom portions 104 and 108 of the bulk bag body, which are made of stitches. The pinches 112 can be formed so that less bulk bag body 102 is pinched near the top and bottom of the bulk bag body and more bulk bag body is pinched near the middle of the bulk bag body to achieve the gradual circumference reduction of the bulk bag body, where the maximum circumference reduction is at the height position of an area slightly below the middle of the bulk bag body, as best illustrated in FIG. 2. In other words, the width of the pinch (the amount of the pinch) is the largest at about the mid-height of the bulk body bag 102, though it can be below or above that location. Thus, the largest amount of the pinch or the height of the bulk bag body 102 where the circumference reduction is the largest may be about 30% to 70% of the entire bag height measured from the bottom of the bulk bag body. As used herein, the term "about" or "approximately" means plus or minus 10%.

Figure 3:
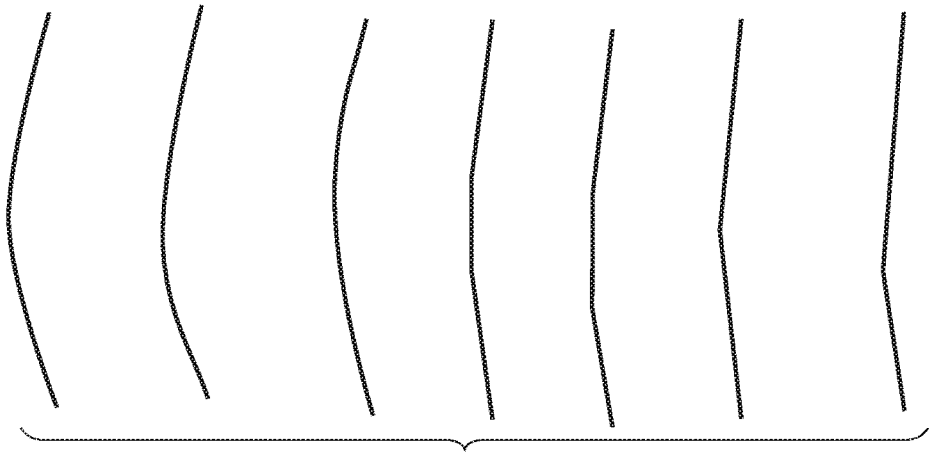
FIG. 3 is an illustration of examples of different sewing patterns that can be used to produce pinches on the body of the bulk bag shown in FIG. 1.

In the illustrated embodiment, the gradual circumference reduction of the bulk bag body 102 is achieved by vertically sewing the four corners of the bulk bag body in a curved manner to pinch the four corners to gradually reduce the circumference of the bulk bag body from the top and bottom of the bulk bag body. The vertical sewing of the bulk bag body 102 at the four corners produces the pinches 112 on the bulk bag body. Examples of different sewing patterns or paths that can be used to produce the pinches 112 on the bulk bag body 102 are illustrated in FIG. 3. As shown in FIG. 3, the sewing patterns or paths can include a curved line, a line with multiple straight line segments and a line with a combination of one or more curved line segments and one or more straight line segments.

Turning back to FIG. 1, the locations of the pinches 112 are not limited to the four vertical corners of the bulk bag body 102. In other embodiments, the vertical pinches 112 can be positioned near the center of the bag walls, i.e., near the middle between the vertical corners of the bulk bag body 102. In fact, the vertical pinches 112 can be located at other locations as long as the overall circumference of the bulk bag body is reduced in the manner described herein. In addition, the number of the vertical pinches 112 are not limited to four pinches. In other embodiments, the bulk bag 100 may include any number of pinches, such as eight or more pinches.

The bulk bag body 102 with the pinches 112 can significantly reduce the bulging of the bulk bag 100, which is illustrated in FIG. 1. On the left side of FIG. 1 is a conventional bulk bag 100-1. As shown in FIG. 1, the conventional bulk bag 100-1 due to its contents has significant bulging beyond the footprint of the bag. In comparison, the bulk bag 100 with the gradual circumference reduction caused by the pinches 112 exhibit significant less bulging, which may be eliminated by increase in the width of the pinch (increased reduction in the circumference of the bulk bag body). In one testing, a 4% pinch (pinch width per corner/bag width) reduced the budging overhang amount by 40%. In this testing, the circumference of the bulk bag body at its minimum (near the middle of the bulk bag body) is 8% less than at its maximum (at the top and bottom of the bulk bag body).

In other embodiments, the bulk bag body 102 may be made of a U panel or four different side panels. In a U-panel bulk bag, the side portion of the bag is formed by sewing two rectangular side panels to a U panel. In a 4-panel bulk bag, the side portion of the bag is formed by sewing four side panels together. For these U-panel and 4-panel bags, the sides of the wall of the bulk bag body can be sewn together along a vertical curve in such a way so the circumference varies according to the vertical position, similar to the circumference reduction using the pinches 112. For other bag styles, a similar treatment can be done on the sewing to achieve the same result on the bulk bag body. The extra edge outside of the sewing stitches that function as pinches can be left on the bag or can be trimmed off either before, during or after the sewing.

Figure 4:
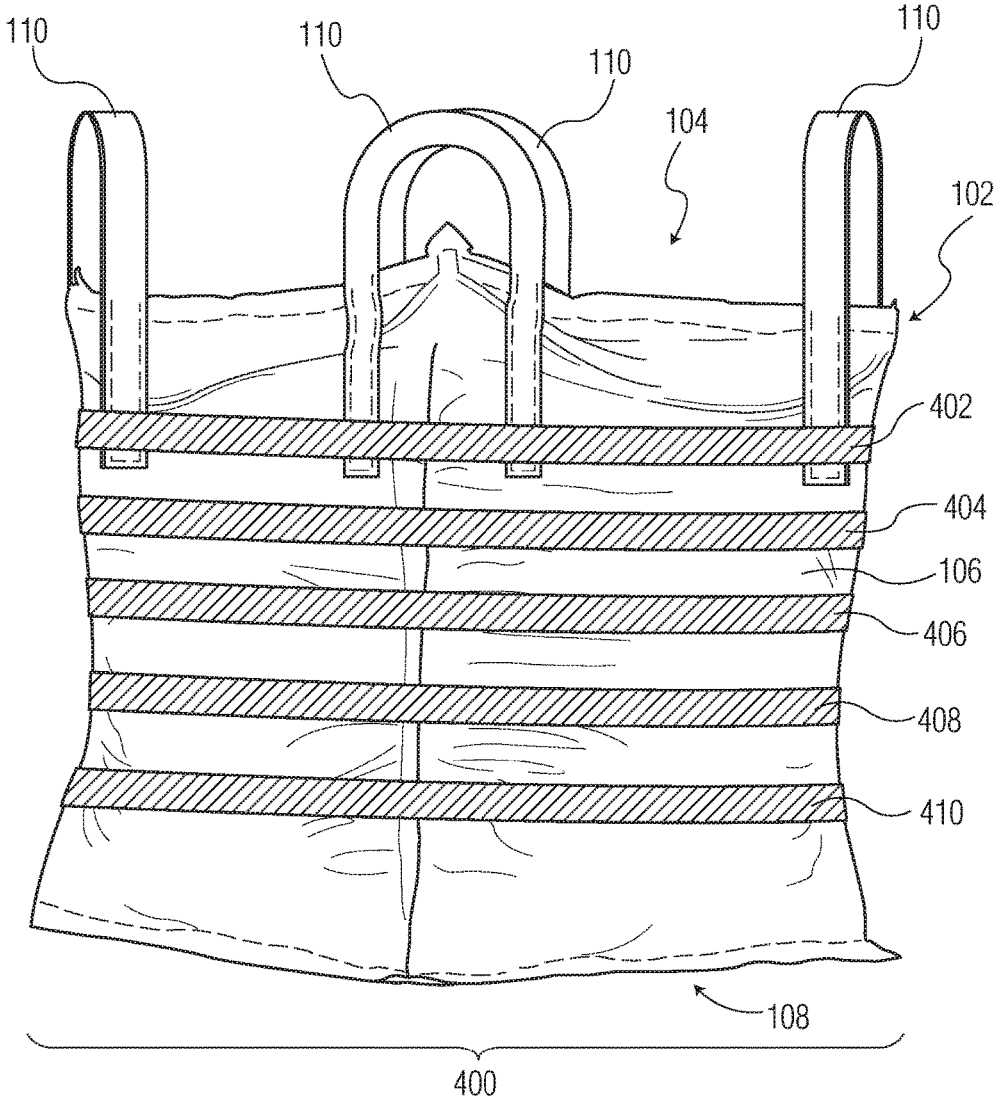
FIG. 4 is a front corner view of a bulk bag in accordance with another embodiment of the invention.

Turning now to FIG. 4, a bulk bag 400 in accordance with another embodiment of the invention is shown. The bulk bag 400 has a bulk bag body that has a varying circumference, similar to the bulk bag 100. However, the bulk bag 400 uses circular fabrics 402, 404, 406, 408 and 410 of varying circumferences to gradually reduce the circumference of the bulk bag body 102. In the illustrated embodiment, the circular fabric 408 is the fabric with the smallest circumference. Thus, as an example, the circumference of the circular fabric 408 may be 8% smaller than the circumference of the bulk bag body 102 at the top or bottom of the bulk bag body, where there is no reduction in the bulk bag body circumference. The circular fabrics 406 and 410 are the fabrics with the second smallest circumference. The circular fabrics 402 and 404 are the fabrics with the third smallest circumference, and thus, are the fabrics with the largest circumferences but smaller than the circumference at the top or bottom of the bulk bag body 102.

In summary, the bulk bags described herein can reduce or eliminate bulging caused their contents. In addition, the bulk bags can lower material and manufacturing cost since baffles are not needed to reduce bulging, which also makes manufacturing of the bulk bag easier. The bulk bags can also be much more stable since the footprint is relatively large or similar compared to the bulk bag body, unlike conventional bulk bags that have smaller footprint relative to the bulging bulk bag body. This can result in reduction of transportation cost due to more efficient use of truck space. Furthermore, due the bulging reduction, bag damage caused by any bulges of the bag is reduced.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A bulk bag comprising:

a bulk bag body that includes a top portion, a bottom potion and a side portion, where the top portion defines a top of the bulk bag body and the bottom portion defines a bottom of the bulk bag body;

a lifting mechanism attached to the bulk bag body, wherein the bulk bag body is configured so that a circumference of the bulk bag body at a particular height between the top and bottom of the bulk bag body is less than a circumference of the bulk bag body at the top of the bulk bag body and less than a circumference of the bulk bag body at the bottom of the bulk bag body to reduce bulging at the side portion of the bulk bag body when the bulk bag body is filled with content; and a plurality of circular fabrics that are attached to the side portion of the bulk bag body, the circular fabrics having different circumferences that define the circumference of the bulk bag body at different heights.

2. The bulk bag of claim 1, wherein the side portion of the bulk bag body is made of a circular tube of fabric, and wherein the side portion includes a plurality of pinches along a vertical direction from the bottom portion of the bulk bag body to the top portion of the bulk bag body that define the circumference of the bulk bag body at different heights.

3. The bulk bag of claim 2, wherein the pinches are formed on the side portion of the bulk bag body using stitches that pinch some of the fabric of the side portion of the bulk bag body.

4. The bulk bag of claim 2, wherein the pinches are located on vertical corners of the side portion of the bulk bag body defined by the top and bottom portions of the bulk bag body.

5. The bulk bag of claim 1, wherein the width of at least one of the pinches is about 4% of a width of a side of the bulk bag body.

6. The bulk bag of claim 1, wherein the circumference of the bulk bag body at the particular height is about 8% less than the circumference of the bulk bag body at the bottom of the bulk bag body.

7. The bulk bag of claim 1, wherein the particular height is located between 30% and 70% of the entire height of the bulk bag body.

8. The bulk bag of claim 1, wherein the side portion of the bulk bag body is made of four rectangular panels of fabric that are stitched together, and wherein vertical stitches on the four rectangular panels of fabric at one corner of the side portion follow a curved path that at least partly defines the circumference of the bulk bag body at different heights.

9. A bulk bag comprising:

a bulk bag body that includes a top portion, a bottom portion and a side portion, where the top portion defines a top of the bulk bag body and the bottom portion defines a bottom of the bulk bag body, wherein the side portion is made of a circular tube of fabric; and a lifting mechanism attached to the bulk bag body, wherein the bulk bag body is configured so that a circumference of the bulk bag body at a particular height between the top and bottom of the bulk bag body is less than a circumference of the bulk bag body at the top of the bulk bag body and less than a circumference of the bulk bag body at the bottom of the bulk bag body to reduce bulging at the side portion of the bulk bag body when the bulk bag body is filled with content; and a plurality of circular fabrics that are attached to the side portion of the bulk bag body, the circular fabrics having different circumferences that define the circumference of the bulk bag body at different heights.

10. The bulk bag of claim 9, wherein the side portion includes a plurality of pinches along a vertical direction from the bottom portion of the bulk bag body to the top portion of the bulk bag body that define the circumference of the bulk bag body at different heights.

11. The bulk bag of claim 10, wherein the pinches are formed on the side portion of the bulk bag body using stitches that pinch some of the fabric of the side portion of the bulk bag body.

12. The bulk bag of claim 10, wherein the pinches are located on vertical corners of the side portion of the bulk bag body defined by the top and bottom portions of the bulk bag body.

13. The bulk bag of claim 9, wherein the width of at least one of the pinches is about 4% of a width of a side of the bulk bag body.

14. The bulk bag of claim 9, wherein the circumference of the bulk bag body at the particular height is about 8% less than the circumference of the bulk bag body at the bottom of the bulk bag body.

15. The bulk bag of claim 9, wherein the particular height is located between 30% and 70% of the entire height of the bulk bag body.

* * * * *